US005992040A

United States Patent [19]

Nordang

[11] Patent Number: 5,992,040

[45] Date of Patent: Nov. 30, 1999

[54] DRYING SECTION APPARATUS

[75] Inventor: Lars N. Nordang, Janesville, Wis.

[73] Assignee: Beloit Technologies, Inc., Wilmington, Del.

[21] Appl. No.: 09/021,803

[22] Filed: Feb. 11, 1998

[51] Int. Cl.[6] ..... F26B 11/02; D21F 5/00

[52] U.S. Cl. ..... 34/114; 34/117; 34/119

[58] Field of Search ..... 34/266, 267, 269, 34/114, 115, 116, 117, 119, 120; 162/206, 207, 135, 136; 427/209, 210; 100/305, 327

[56] References Cited

U.S. PATENT DOCUMENTS

| | | | |
|---|---|---|---|
| 5,557,860 | 9/1996 | Kotitschke et al. | 34/455 |
| 5,592,751 | 1/1997 | Guggemos et al. | 34/117 |
| 5,634,402 | 6/1997 | Rudd et al. | 34/266 X |
| 5,641,387 | 6/1997 | Baldini | 34/117 X |
| 5,756,156 | 5/1998 | Elijoki et al. | 34/114 X |

*Primary Examiner*—Henry Bennett
*Assistant Examiner*—Steve Gravini
*Attorney, Agent, or Firm*—Raymond W. Campbell; Gerald A. Mathews

[57] ABSTRACT

A drying section apparatus is disclosed for drying a web of paper. The apparatus includes a size press for applying size to at least one side of the web. A single tier dryer is disposed downstream relative to the size press for drying the web. The single tier dryer includes a plurality of dryer cylinders and a plurality of vacuum rolls. Each of the vacuum rolls is disposed between adjacent dryer cylinders of the plurality of dryer cylinders. A dryer felt extends around at least one of the dryer cylinders. The arrangement is such that at least one of the dryer cylinders is top felted for permitting downward removal of broke. An air cap is disposed above at least one of the dryer cylinders for blowing air through the felt for drying the web disposed between the dryer cylinder and the felt. The arrangement is such that both sides of the web are dried during passage of the web through the single tier dryer.

12 Claims, 2 Drawing Sheets

DRYING SECTION APPARATUS

BACKGROUND OF THE INVENTION

FIELD OF THE INVENTION

The present invention relates to a drying section apparatus for drying a web of paper.

More specifically, the present invention relates to a single tier dryer for drying a web.

INFORMATION DISCLOSURE STATEMENT

In the manufacture of a web of paper, a pressed web is guided around a plurality of heated dryer cylinders so that thermal energy is transferred to the web for driving therefrom the remaining moisture contained therein.

U.S. Pat. No. 5,269,074 assigned to Beloit Technologies teaches a single tier dryer means in which each of the dryer cylinders is arranged in a single row with vacuum rolls disposed between adjacent dryer cylinders. A dryer felt extends alternately around each dryer cylinder and vacuum roll for guiding the web into surface contact with each dryer cylinder for drying the web. As disclosed in the aforementioned '074 patent, each of the dryer cylinders is top felted for facilitating downward removal of broke in the event of a web breakage. The single tier concept disclosed in the '074 patent permits restrained drying of the web during the drying process. More specifically, the web is supported throughout the entire movement thereof through the single tier dryer means thereby improving the properties of the resultant web and restraining the web against particularly cross machine directional shrinkage thereof. Two-sided drying for improved curl control is provided by using a two-tier dryer section for such control.

However, in many drying applications, a coating of size must be applied to the web in order to decrease the permeability of the resultant dried web thereby enhancing the printability thereof.

When size is applied to a dried web, the sized web increases in water content so that the sized web must be further dried.

The present invention includes the provision of a single tier dryer arrangement with air caps disposed above the dryer cylinders so that both sides of the sized web are able to be controllably dried.

Therefore, it is a primary objective of the present invention to provide a drying section apparatus which overcomes the problems associated with the prior art arrangements for drying a sized web and which makes a considerably contribution to the art of drying a web of paper.

Other objects and advantages of the present invention will be readily apparent to those skilled in the art by consideration of the detailed description contained hereinafter taken in conjunction with the annexed drawings.

SUMMARY OF THE INVENTION

The present invention relates to a drying section apparatus for drying a web of paper. The apparatus includes a size press means for applying size to at least one side of the web. A single tier dryer means is disposed downstream relative to the size press means for drying the web. The dryer means includes a plurality of dryer cylinders and a plurality of vacuum rolls. Each of the vacuum rolls is disposed between adjacent dryer cylinders of the plurality of dryer cylinders.

A dryer felt means extends around at least one of the dryer cylinders. The arrangement is such that at least one of the dryer cylinders is top felted for permitting downward removal of broke.

Air cap means are disposed above at least one of the dryer cylinders for blowing air through the felt for drying the web disposed between the at least one dryer cylinder and the felt. The arrangement is such that both sides of the web are dried during passage of the web through the dryer means.

In a more specific embodiment of the present invention, the size press means includes a frame and an applicator roll which is rotatably supported by the frame. The applicator roll has a circumferential applicator surface.

A size applicator cooperates with the applicator surface for applying size to the surface. The arrangement is such that at least one of the sides of the web is brought into contact with the surface downstream relative to the size applicator so that size is applied to the at least one side of the web.

The apparatus also includes a further applicator roll which is rotatably supported by the frame. The further roll and the applicator roll cooperate together to define therebetween a nip for the passage therethrough of the web. The further applicator roll defines a further circumferential surface.

A further size applicator cooperates with the further surface for applying size to the further surface. The arrangement is such that the size applied to the further surface is brought into contact with a side of the web which is opposite to the at least one side so that both sides of the web are coated with size.

In an alternative embodiment of the present invention, the drying section apparatus further includes an initial single tier dryer means for drying the web.

A further size press means is disposed downstream relative to the initial dryer means for applying size to a side of the web opposite to the at least one side of the web.

More specifically, the apparatus further includes an infrared heater which is disposed between the size press means and the initial dryer means for drying the web. A further infrared heat is disposed between the further size press means and the dryer means for further drying the web.

More specifically, in the first embodiment of the present invention, the plurality of dryer cylinders includes an unfelted upstream cylinder for guiding the web.

Also, the dryer felt means includes a looped dryer felt which is guided into contact with the unfelted upstream dryer cylinder. The arrangement is such that the web is transferred from the upstream dryer cylinder onto the dryer felt so that the web supported by the felt is guided alternately around the vacuum rolls and the dryer cylinders of the dryer means.

In a preferred embodiment of the present invention, the apparatus further includes a single tier group of dryer cylinders with the felt extending alternately around the vacuum rolls and the dryer cylinders of the group.

The apparatus also includes a further single tier group of dryers having a further felt which extends alternately around the vacuum rolls and the dryer cylinders of the further group. The further felt transfers the web from the group to the further group and both the group and the further group are top felted.

More particularly, the further group is disposed downstream relative to the group of dryer cylinders and the air cap means is disposed above at least two of the dryer cylinders of the further group.

The air cap means includes control means for controlling the flow of air through the felt means.

More specifically, the air cap means includes means for heating the air so that hot air is blown by the air cap means through the felt means for drying a side of the web opposite to a side of the web which comes into direct surface contact with the dryer cylinder. The arrangement is such that the drying of the size applied to the web is controllably accomplished during passage of the sized web through the dryer means.

Many modifications and variations of the present invention will be readily apparent to those skilled in the art by a consideration of the detailed description contained hereinafter taken in conjunction with the annexed drawings.

However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
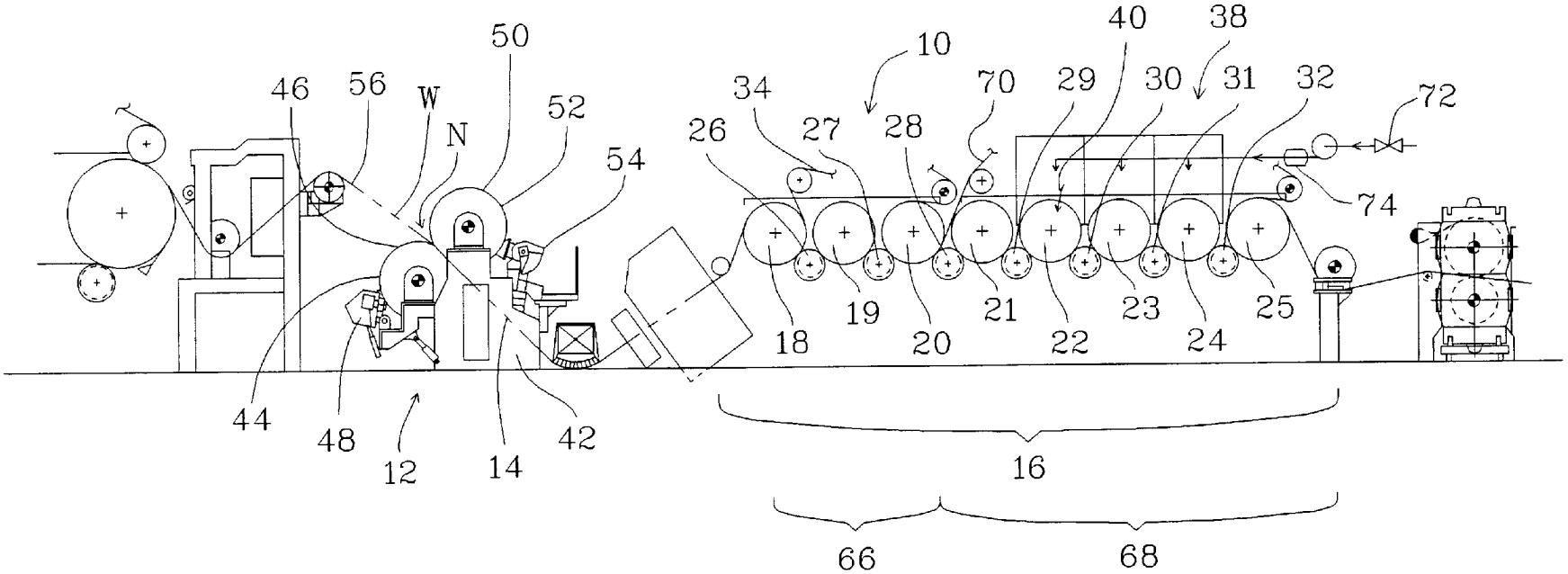
FIG. 1 is a side elevational view of a drying section apparatus according to the present invention.

FIG. 1 is a side elevational view of a drying section apparatus generally designated 10 for drying a web of paper W. The apparatus 10 includes a size press means generally designated 12 for applying size to at least one side 14 of the web W. A single tier dryer means generally designated 16 is disposed downstream relative to the size press means 12 for drying the web W. The dryer means 16 includes a plurality of dryer cylinders 18,19,20,21,22,23,24 and 25 and a plurality of vacuum rolls 26,27,28,29,30,31 and 32. Each vacuum roll, such as 27, of the plurality of vacuum rolls 26–32 is disposed between adjacent dryer cylinders 19,20 of the plurality of dryer cylinders 18–25.

A dryer felt 34 extends around at least one of the dryer cylinders 19. The arrangement is such that the at least one dryer cylinder 19 is top felted as shown in FIG. 1 for permitting downward removal of broke as indicated by the arrow 36. Air caps means generally designated 38 are disposed above at least one of the dryer cylinders 22 for blowing air as indicated by the arrow 40 through a further felt for drying the web W disposed between the at least one dryer cylinder 22 and the further felt. The arrangement is such that both sides of the web W are dried during passage of the web W through the dryer means 16.

As shown in FIG. 1, the size press means 12 includes a frame 42 and an applicator roll 44 which is rotatably supported by the frame 42. The applicator roll 44 has a circumferential applicator surface 46.

A size applicator 48 cooperates with the applicator surface 46 for applying size to the surface 46. The arrangement is such that at least one side 14 of the web W is brought into contact with the surface 46 downstream relative to the size applicator 48 so that size is applied to the at least one side 14 of the web W.

The apparatus 10 also includes a further applicator roll 50 which is rotatably supported by the frame 42. The further roll 50 and the applicator roll 44 cooperate together to define therebetween a nip N for the passage therethrough of the web W. The further applicator roll 50 defines a further circumferential surface 52.

A further size applicator 54 cooperates with the further surface 52 for applying size to the further surface 52. The arrangement is such that the size applied to the further surface 52 is brought into contact with a side 56 of the web W opposite to the at least one side 14 so that both sides 14 and 56 of the web W are coated with size.

Figure 2:
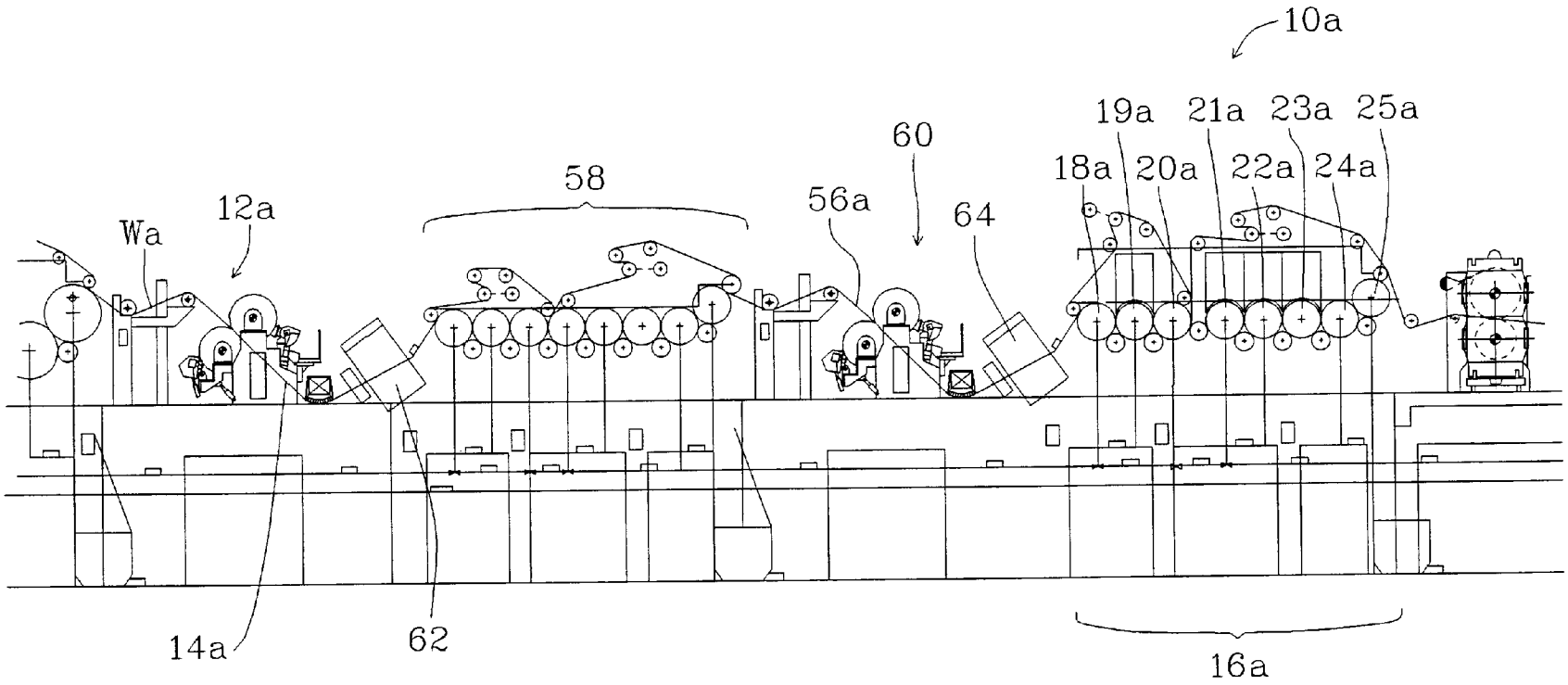
FIG. 2 is a side elevational view of a drying section apparatus according to a further embodiment of the present invention.

FIG. 2 is a side elevational view of a drying section apparatus according to a further embodiment of the present invention. FIG. 2 shows an initial single tier dryer means 58 for drying the web Wa. A further size press means 60 is disposed downstream relative to the initial dryer means 58 for applying size to a side 56*a* of the web Wa opposite to the at the least one side 14*a* of the web Wa.

As shown in FIG. 2, the apparatus 10*a* further includes an infrared heater 62 which is disposed between the size press means 12*a* and the initial dryer means 58 for drying the web Wa.

Also, a further infrared heater 64 is disposed between the further size press means 60 and the dryer means 16*a* for drying the web Wa.

As shown in the embodiment of FIG. 1, the plurality of dryer cylinders 18–25 includes an unfelted upstream cylinder 18 for guiding the web W.

The dryer felt 34 is a looped dryer felt which is guided into contact with the unfelted dryer cylinder 18. The arrangement is such that the web W is transferred from the upstream unfelted dryer cylinder 18 onto the dryer felt 34 so that the web W supported by the felt 34 is guided alternately around the vacuum rolls 26–27 and the dryer cylinders 19–20 of the dryer means 16.

In a preferred embodiment of the present invention as shown in FIG. 1, the apparatus 10 includes a single tier group 66 of dryer cylinders 19,20 with the felt 34 extending alternately around the vacuum rolls 26,27 and the dryer cylinders 19,20 of the group 66.

A further single tier group 68 of dryer cylinders 21–25 is disposed downstream relative to the group 66 and the further felt 70 extends alternately around the vacuum rolls 28–32 and the dryer cylinders 21–25 of the further group 68. The further felt 70 transfers the web W from the group 66 to the further group 68 and both groups 66,68 of dryer cylinders are top felted.

The air cap means 38 is disposed above at least two of the dryer cylinders 22,23 of the further group 68.

More specifically, the air cap means 38 includes control means 72 for controlling a flow of air as indicated by the arrow 40 through the further felt 70.

The air cap means 38 includes means 74 for heating the air so that hot air is blown by the air cap means 38 through the further felt 70 for drying a side 56 of the web W opposite to the side 14 of the web W which comes into direct surface contact with a dryer cylinder 22. The arrangement is such that the drying of the size applied to the web is controllably accomplished during passage of the sized web through the dryer means 1 6.

The present invention provides a unique arrangement which enhances the ability to dry a sized web.

What is claimed is:

1. A drying section apparatus for drying a web of paper, said apparatus comprising:

size press means for applying size to at least one side of the web;

a single tier dryer means disposed downstream relative to said size press means for drying the web;

said dryer means including:

a plurality of dryer cylinders;

a plurality of vacuum rolls, each vacuum roll of said plurality of vacuum rolls being disposed between adjacent dryer cylinders of said plurality of dryer cylinders;

a dryer felt means extending around at least one of said dryer cylinders, the arrangement being such that said at least one dryer cylinder is top felted for permitting downward removal of broke; and air cap means disposed above at least one of said dryer cylinders for blowing air through said felt means for drying the web disposed between said at least one dryer cylinder and said felt means, the arrangement being such that both sides of the web are dried during passage of the web through said dryer means.

2. A dryer section apparatus as set forth in claim 1, wherein said size press means includes:

a frame;

an applicator roll rotatably supported by said frame, said applicator roll having a circumferential applicator surface;

a size applicator cooperating with said applicator surface for applying size to said surface, the arrangement being such that said at least one side of the web is brought into contact with said surface downstream relative to said size applicator so that size is applied to said at least one side of the web.

3. A drying section apparatus as set forth in claim 2, further including:

a further applicator roll rotatably supported by said frame, said further roll and said applicator roll cooperating together to define therebetween a nip for the passage therethrough of the web, said further applicator roll defining a further circumferential surface;

a further size applicator cooperating with said further surface for applying size to said further surface, the arrangement being such that the size applied to said further surface is brought into contact with a side of the web opposite to said at least one side so that both sides of the web are coated with size.

4. A drying section apparatus as set forth in claim 2, further including:

an initial single tier dryer means disposed between said applicator roll and said dryer means for drying the web;

a further size press means disposed downstream relative to said initial dryer means for applying size to a side of the web opposite to said at least one side of the web.

5. A drying section apparatus as set forth in claim 4, further including:

an infrared heater disposed between said size press means and said initial dryer means for drying the web;

a further infrared heater disposed between said further size press means and said dryer means for drying the web.

6. A drying section apparatus as set forth in claim 1, wherein said plurality of dryer cylinders includes:

an unfelted upstream cylinder for guiding the web.

7. A drying section apparatus as set forth in claim 6, wherein said dryer felt means includes:

a looped dryer felt which is guided into contact with said unfelted upstream dryer cylinder the arrangement being such that the web is transferred from said upstream dryer cylinder onto said dryer felt so that the web supported by said felt is guided alternately around said vacuum rolls and said dryer cylinders of said dryer means.

8. A drying section apparatus as set forth in claim 7, further including:

a single tier group of dryer cylinders, said felt extending alternately around said vacuum rolls and said dryer cylinders of said group;

a further single tier group of dryer cylinders;

a further felt extending alternately around said vacuum rolls and dryer cylinders of said further group;

said further dryer felt transferring the web from said group to said further group, said group and said further group of dryer cylinders being top felted.

9. A drying section apparatus as set forth in claim 1, wherein said dryer means further includes:

a group of dryer cylinders;

a further group of dryer cylinders disposed downstream relative to said group of dryer cylinders;

said air cap means being disposed above at least two of said dryer cylinders of said further group.

10. A drying section apparatus as set forth in claim 9, wherein said air cap means includes:

control means for controlling a flow of the air through said felt means.

11. A drying section apparatus as set forth in claim 10, wherein said air cap means includes:

means for heating the air so that hot air is blown by said air cap means through said felt means for drying a side of the web opposite to a side of the web which comes into direct surface contact with a dryer cylinder, the arrangement being such that the drying of the size applied to the web is controllably accomplished during passage of the sized web through said dryer means.

12. A drying section apparatus for drying a web of paper, said apparatus comprising:

size press means for applying size to at least one side of the web;

a single tier dryer means disposed downstream relative to said size press means for drying the web;

said dryer means including:

a plurality of dryer cylinders;

a plurality of vacuum rolls, each vacuum roll of said plurality of vacuum rolls being disposed between adjacent dryer cylinders of said plurality of dryer cylinders;

a dryer felt means extending around at least one of said dryer cylinders, the arrangement being such that said at least one dryer cylinder is top felted for permitting downward removal of broke; and air cap means controllably blowing hot air through said felt means and onto the web, said felt means having a permeability which permits flow of heated air therethrough.

* * * * *